US007547104B1

(12) United States Patent
Nadonley

(10) Patent No.: US 7,547,104 B1
(45) Date of Patent: Jun. 16, 2009

(54) REFLECTOR SYSTEM

(76) Inventor: Leonard W. Nadonley, 536 Summit Dr., Windber, PA (US) 15963

( * ) Notice: Subject to any disclaimer, the term of this patent is extended or adjusted under 35 U.S.C. 154(b) by 213 days.

(21) Appl. No.: 11/650,507

(22) Filed: Jan. 8, 2007

(51) Int. Cl.
*G02B 5/12* (2006.01)

(52) U.S. Cl. ..... 359/515; 359/532; 359/547; 359/553

(58) Field of Classification Search ..... 359/515, 359/532, 547, 552
See application file for complete search history.

(56) References Cited

U.S. PATENT DOCUMENTS 3,355,998 A * 12/1967 Roemisch ..... 403/2
3,680,448 A * 8/1972 Ballingall et al. ..... 52/169.12
3,989,351 A 11/1976 Bjorlund
4,353,665 A 10/1982 Green
4,413,923 A 11/1983 Wright
D362,818 S 10/1995 Sandy
5,731,895 A 3/1998 Owczarzak et al.
D453,700 S 2/2002 Tremmel
6,558,011 B2 5/2003 Fritz
6,823,814 B2 * 11/2004 Bukky ..... 116/209
6,851,615 B2 2/2005 Jones

* cited by examiner

*Primary Examiner*—James Phan

(57) ABSTRACT

A reflector system for to allow a reflector to be positioned adjacent an edge of road while reducing the chance of being struck by a vehicle includes a spike being drivable into and extending upwardly from a support surface. The spike includes a tapered end for facilitating driving of the spike into the support surface. The spike has a slot therein extending through a pair of sides of the spike and positioned adjacent a top end of the spike. A reflector is couplable to the spike. The reflector is positioned in the slot of the spike when the reflector is coupled to the spike. The reflector reflects light from the headlights of the vehicle to alert a driver to an edge of a road adjacent the reflector.

11 Claims, 5 Drawing Sheets

REFLECTOR SYSTEM

BACKGROUND OF THE INVENTION

1. Field of the Invention

The present invention relates to reflective markers and more particularly pertains to a new reflective marker for to allow a reflector to be positioned adjacent an edge of road while reducing the chance of being struck by a vehicle.

2. Description of the Prior Art

The use of reflective markers is known in the prior art. While these devices fulfill their respective, particular objectives and requirements, the need remains for a system that has certain improved features that allow for a reflector of the system to be adjusted vertically and horizontally to a desired location. The system may be used adjacent to roadways to act as safety reflectors for both vehicles and for maintenance and construction personnel. Additionally, the system should provide an armature to allow the system to be positioned to reduce a chance that the system's support or a person implementing the system is inadvertently struck by a vehicle.

SUMMARY OF THE INVENTION

The present invention meets the needs presented above by generally comprising a spike being drivable into and extending upwardly from a support surface. The spike includes a tapered end for facilitating driving of the spike into the support surface. The spike has a slot therein extending through a pair of sides of the spike and positioned adjacent a top end of the spike. A reflector is couplable to the spike. The reflector is positioned in the slot of the spike when the reflector is coupled to the spike. The reflector reflects light from the headlights of a vehicle to alert a driver to an edge of a road adjacent the reflector.

There has thus been outlined, rather broadly, the more important feature of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
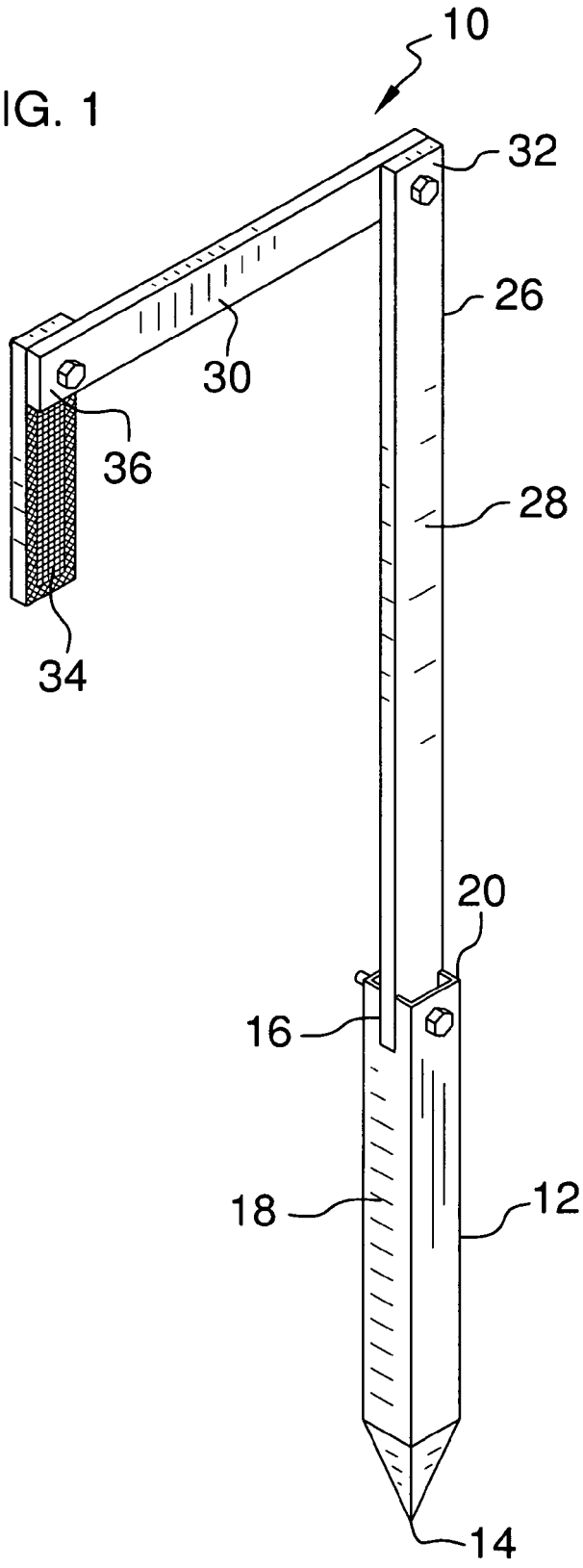
FIG. 1 is a front perspective view of a reflector system according to the present invention.
Figure 2:
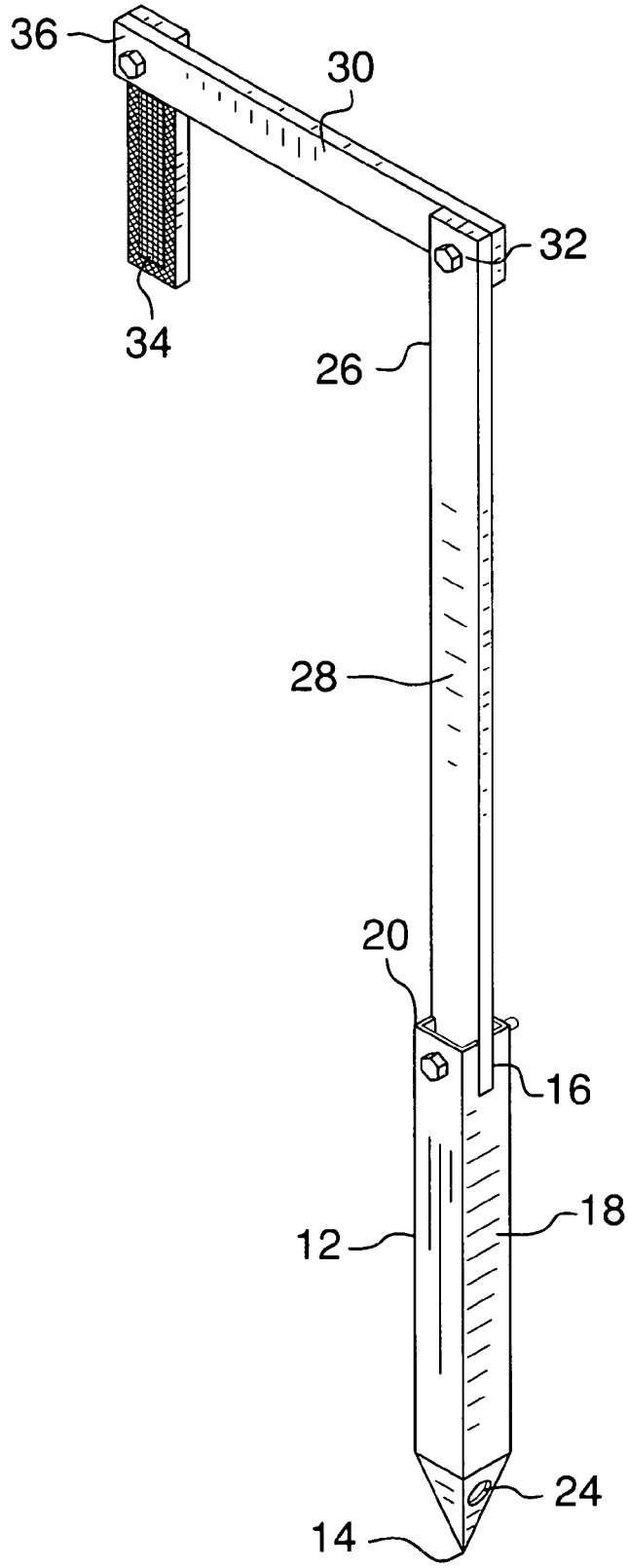
FIG. 2 is a side perspective view of the present invention.
Figure 3:
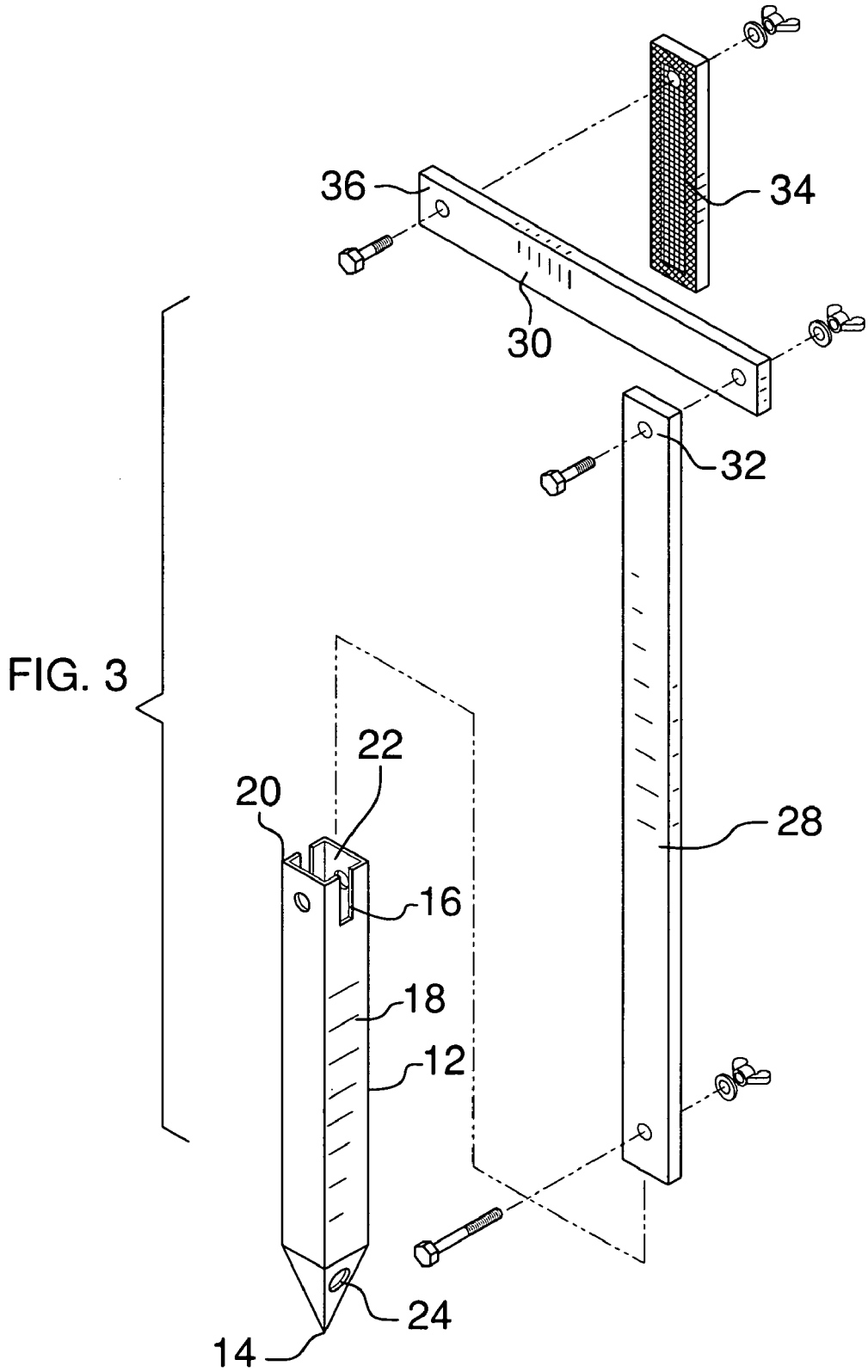
FIG. 3 is an exploded perspective view of the present invention.
Figure 4:
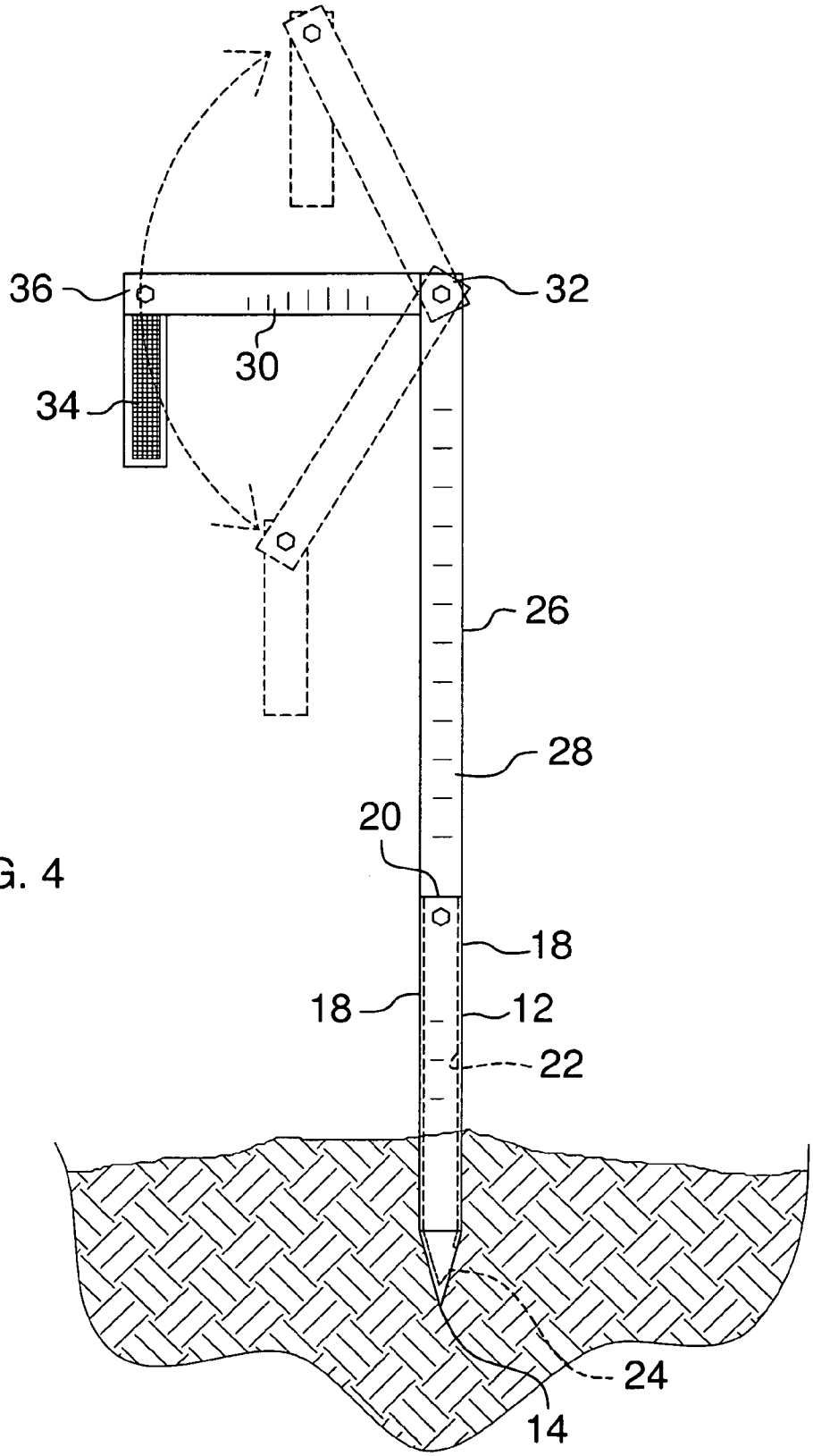
FIG. 4 is a front view of the present invention shown in use.

With reference now to the drawings, and in particular to FIGS. 1 through 6 thereof, a new reflective marker embodying the principles and concepts of the present invention and generally designated by the reference numeral 10 will be described.

As best illustrated in FIGS. 1 through 6, the reflector system 10 generally comprises a spike 12 being drivable into and extending upwardly from a support surface. The spike 12 includes a tapered end 14 for facilitating driving of the spike 12 into the support surface. The spike 12 has a slot 16 therein extending through a pair of sides 18 of the spike 12 and positioned adjacent a top end 20 of the spike 12. The spike 12 has a drainage hole 22 extending into the spike 12 through the top end 20 of the spike 12. The spike 12 has a drainage aperture 24 extending into the spike 12 and in fluid communication with the drainage hole 22. The drainage aperture 24 permits fluids collected in the drainage hole 22 to drain out of the spike 12. The drainage aperture 24 is positioned adjacent the tapered end 14. The spike 12 has a length of approximately 24 inches.

An armature 26 is hingedly coupled to the spike 12. A portion of the armature 26 is positioned in the slot 16 of the spike 12. The armature 26 extends upwardly from the spike 12. An angle of the armature 26 with respect to the spike 12 is adjustable. The armature 26 includes a first arm 28 hingedly coupled to the top end 20 of the spike 12. A portion of the first arm 28 is positioned in the slot 16 of the spike 12. The first arm 28 has a length between approximately 24 inches and approximately 48 inches. An angle of the first arm 28 with respect to the spike 12 is adjustable. A second arm 30 is hingedly coupled to a free end 32 of the first arm 28. An angle of the second arm 30 with respect to the first arm 28 is adjustable. The second arm 30 has a length of approximately 24 inches.

Figure 6:
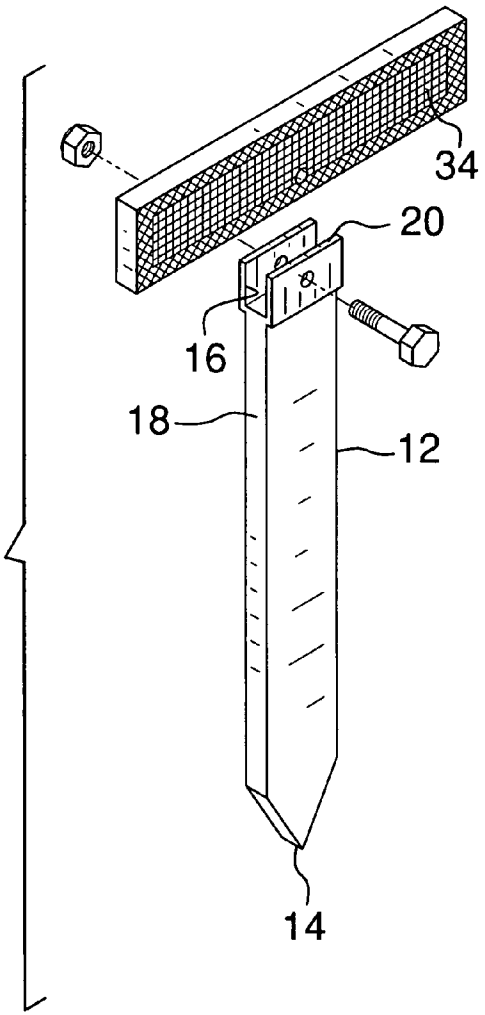
FIG. 6 is an exploded perspective view of the embodiment of the present invention shown in FIG. 5.
Figure 5:
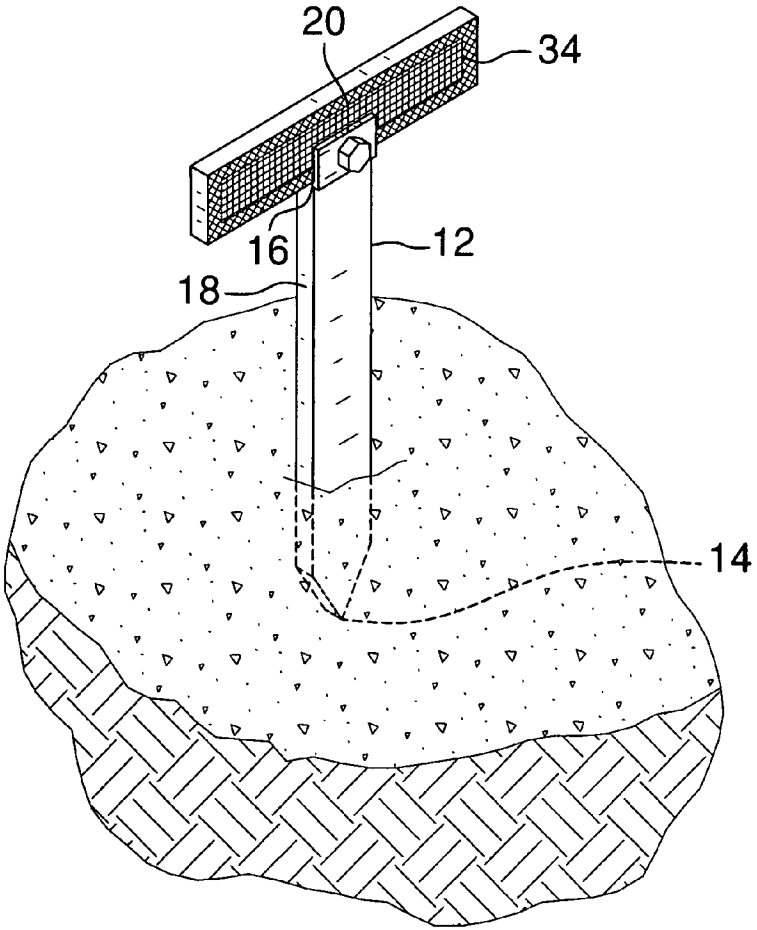
FIG. 5 is a perspective view of an embodiment of the present invention showing the reflector coupled directly to the spike.

A reflector 34 is coupled to the armature 26. The armature 26 is adjusted to change a vertical and horizontal orientation of the reflector 34 with respect to the spike 12. The reflector 34 is coupled to a distal end 36 of the second arm 30 with respect to the first arm 28. The reflector 34 reflects light from headlights of a vehicle to alert a driver to an edge of road adjacent the reflector 34. In an embodiment, as shown in FIGS. 5 and 6, the reflector 34 may be directly coupled to the spike 12. A portion of the reflector 34 is positioned in the slot 16 of the spike 12.

In use, the tapered end 14 of the spike 12 is placed against the support surface and the spike 12 is driven into the support surface. The armature 26 is coupled to the spike 12 with a portion of the armature 26 positioned in the slot 16 of the spike 12. The reflector 34 is coupled to the armature 26 to reflect the light from the headlights of a vehicle and indicate the edge of the rod adjacent to the reflector 34. The first arm 28 and the second arm 30 are adjusted to position the reflector 34 at the desired vertical and horizontal position with respect to the spike 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reflector system for reflecting light from headlights of a vehicle, said system comprising:

a spike being drivable into and extending upwardly from a support surface, said spike including a tapered end for facilitating driving of said spike into the support surface, said spike having a slot therein extending through a pair of sides of said spike and positioned adjacent a top end of said spike, said spike having a drainage hole extending therein through said top end of said spike, said spike having a drainage aperture extending into said spike and in fluid communication with said drainage hole, said drainage aperture permitting fluid collected in said drainage hole to drain out of said spike; and a reflector being couplable to said spike, said reflector being positioned in said slot of said spike when said reflector is coupled to said spike, said reflector reflecting light from the headlights of the vehicle to alert a driver to an edge of a road adjacent said reflector.

2. The system according to claim 1, wherein said drainage aperture is positioned adjacent said tapered end.

3. The system according to claim 1, further comprising an armature being hingedly coupled between said spike and said reflector, a portion of said armature being positioned in said slot of said spike, said armature extending upwardly from said spike, an angle of said armature with respect to said spike being adjustable, said armature being adjusted to change a vertical and horizontal orientation of said reflector with respect to said spike.

4. The system according to claim 3, wherein said armature includes a first arm being hingedly coupled to said top end of said spike, a portion of said first arm being positioned in said slot of said spike, an angle of said first arm with respect to said spike being adjustable.

5. The system according to claim 4, wherein said armature includes a second arm being hingedly coupled to a free end of said first arm, an angle of said second arm with respect to said first arm being adjustable.

6. The system according to claim 5, wherein said armature includes said reflector being coupled to a distal end of said second arm with respect to said first arm.

7. A reflector system for reflecting light from headlights of a vehicle, said system comprising:

a spike being drivable into and extending upwardly from a support surface, said spike including a tapered end for facilitating driving of said spike into the support surface, said spike having a slot therein extending through a pair of sides of said spike and positioned adjacent a top end of said spike, said spike having a drainage hole extending into said spike through said top end of said spike, said spike having a drainage aperture extending into said spike and in fluid communication with said drainage hole, said drainage aperture permitting fluid collected in said drainage hole to drain out of said spike, said drainage aperture being positioned adjacent said tapered end;

an armature being hingedly coupled to said spike, a portion of said armature being positioned in said slot of said spike, said armature extending upwardly from said spike, an angle of said armature with respect to said spike being adjustable, said armature comprising:

a first arm being hingedly coupled to said top end of said spike, a portion of said first arm being positioned in said slot of said spike, an angle of said first arm with respect to said spike being adjustable;

a second arm being hingedly coupled to a free end of said first arm, an angle of said second arm with respect to said first arm being adjustable; and a reflector being coupled to said armature, said armature being adjusted to change a vertical and horizontal orientation of said reflector with respect to said spike, said reflector being coupled to a distal end of said second arm with respect to said first arm, said reflector reflecting light from the headlights of the vehicle to alert a driver to an edge of road adjacent said reflector.

8. A reflector system for reflecting light from headlights of a vehicle, said system comprising:

a spike being drivable into and extending upwardly from a support surface, said spike including a tapered end for facilitating driving of said spike into the support surface, said spike having a slot therein extending through a pair of sides of said spike and positioned adjacent a top end of said spike;

a reflector being couplable to said spike, said reflector being positioned in said slot of said spike when said reflector is coupled to said spike, said reflector reflecting light from the headlights of the vehicle to alert a driver to an edge of a road adjacent said reflector; and an armature being hingedly coupled between said spike and said reflector, a portion of said armature being positioned in said slot of said spike, said armature extending upwardly from said spike, an angle of said armature with respect to said spike being adjustable, said armature being adjusted to change a vertical and horizontal orientation of said reflector with respect to said spike.

9. The system according to claim 8, wherein said armature includes a first arm being hingedly coupled to said top end of said spike, a portion of said first arm being positioned in said slot of said spike, an angle of said first arm with respect to said spike being adjustable.

10. The system according to claim 9, wherein said armature includes a second arm being hingedly coupled to a free end of said first arm, an angle of said second arm with respect to said first arm being adjustable.

11. The system according to claim 10, wherein said armature includes said reflector being coupled to a distal end of said second arm with respect to said first arm.

* * * * *